United States Patent [19]

Grunert et al.

[11] 3,940,829

[45] Mar. 2, 1976

[54] PARALLEL ROD FURNITURE HINGE

[75] Inventors: Hellmuth Grunert, Hoffnungstahl; Theodor Vitt, Porz-Eil, both of Germany

[73] Assignee: Prameta Prazisionsmetall -und Kunststofferzeugnisse G. Baumann & Co., Cologne, Germany

[22] Filed: Mar. 15, 1974

[21] Appl. No.: 451,562

[30] Foreign Application Priority Data

Mar. 17, 1973 Germany ..... 2319549

[52] U.S. Cl. ..... 16/163; 16/168

[51] Int. Cl.[2] ..... E05D 3/06

[58] Field of Search ..... 16/163, 164, 165, 166, 16/168, 169, 156, 188, 183, 173, 129, 130, 131, 132, 136

[56] References Cited

UNITED STATES PATENTS

| | | | |
|---|---|---|---|
| 1,382,654 | 6/1921 | Korb | 16/164 |
| 2,200,699 | 5/1940 | McNulty | 16/164 |
| 2,395,501 | 2/1946 | Peterson | 16/164 |
| 3,141,190 | 7/1964 | Reiss | 16/136 X |
| 3,605,173 | 9/1971 | Lautenschlager | 16/164 X |
| 3,724,021 | 4/1973 | Lautenschlaeger | 16/164 X |

FOREIGN PATENTS OR APPLICATIONS

| | | | |
|---|---|---|---|
| 981,082 | 1/1965 | United Kingdom | 16/168 |

*Primary Examiner*—George H. Krizmanich
*Attorney, Agent, or Firm*—Diller, Brown, Ramik & Wight

[57] ABSTRACT

This disclosure relates to a hinge for abutting door sashes and particularly a furniture hinge in which a linkage is provided in the form of a pair of rods pivotally mounted between mounting parts of an associated frame and sash, each radius rod having an end within a large diameter trunnion of a thickness greater than that of the associated rods, and each trunnion engaging in a corresponding bore of the sash.

5 Claims, 5 Drawing Figures

PARALLEL ROD FURNITURE HINGE

The present invention relates to a novel hinge for door sashes which abut each other and particularly to a furniture hinge which includes rods mounted between a furniture frame and an associated sash with each rod having an enlarged pintle or pivot journaled for rotation in bearings or bores of the sash.

It is conventional to journal or pivotally mount rods of hinges of the type described heretofore, in a mounting element such that the rods are provided with bores receiving therethrough pins which function as a pintle or a pivot for the hinge. In this type of arrangement the joint is relatively weak because the rods are apertured and even though the opposite apertured ends may be enlarged the same are relatively weak. This is highly detrimental since door sashes are supported entirely by the pins or pintles within the bores of the rods and, thus, the rods and pins carry a relatively large weight. Needless to say the risk of wear is relatively high and as wear occurs between the pins and the bored rods sagging of the door sash will occur. Furthermore, a relatively small amount of clearance is visibly noticeable in relatively broad door sashes.

In view of the foregoing, it is a primary object of this invention to provide a novel hinge for journaling rods in mounting elements of furniture hinges and the like in which precision journaling of the rods is insured even though the sashes are relatively heavy. In the case of a hinge for abutting door sashes of the type mentioned heretofore, the invention is particularly characterized in that the ends of the rods, normally referred to as radius rods, are formed as projecting bearings or trunnions whose diameters are substantially in excess of the thickness of the rods. In this manner, the specific surface pressure imposed on these trunnions is substantially reduced, wear is eliminated thus reducing sagging of the sash, and the overall precision of the hinge system can be simply, easily and reliably maintained.

In further accordance with this invention, the hinge preferably includes bushings constructed of plastic, particularly self-lubricating plastic, to achieve a simplified installation of the trunnions and a high degree of durability of the overall hinge construction.

In further accordance with this invention, the mounting elements are preferably provided with bores which function as journals or bearings for accommodating the trunnions of the rods and preferably the bearings are covered externally by means of a retaining plate which is inserted into slits of the mounting element to thereby protect the operative parts against the ingress of dirt, moisture, and the like.

With the above and other objects in view that will hereinafter appear, the nature of the invention will be more clearly understood by reference to the following detailed description, the appended claimed subject matter, and the several views illustrated in the accompanying drawing.

Figure 1:
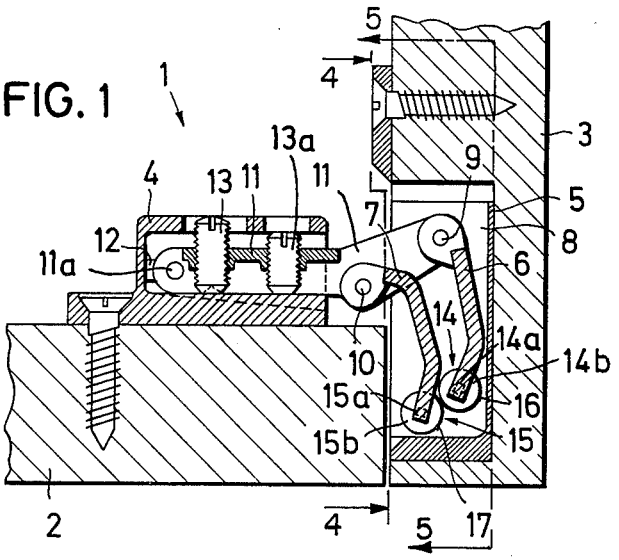
FIG. 1, is a fragmentary cross-sectional view of a novel hinge construction of the present invention, and illustrates the hinge connected to a frame and sash in the relatively closed position thereof.
Figure 2:
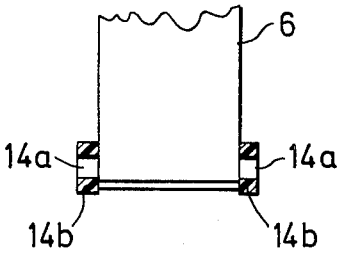
FIGS. 2 and 3 illustrate one of a pair of radius rods having enlarged trunnions at sides thereof.

In accordance with this invention a novel hinge 1 is best illustrated in FIG. 1 of the drawing and is mounted between a sash 3 and frame 2 by mounting elements or parts 4 and 5. The mounting elements 4 and 5 are secured to the frame 2 and sash 3 respectively, by screws or like elements (unnumbered). The mounting elements 4 and 5 are interconnected by a pair of radius rods 6 and 7, FIG. 1, which are disposed in a recessed 8 of the mounting element 5. The rods 6 and 7 have free ends connected to an arm 11 by pivot pins 9 and 10 to form a parallelogram linkage in conjunction with opposite bearings or trunnions 14 and 15. The arm 11 is preferably slidably mounted by a pivot pin 11*a* in longitudinal recesses 12 of the mounting element 4 and is adjusted in any one of a plurality of desired angular positions by means of a pair of screws 13 and 13*a*. The screws are threaded into the arm 11, as is readily apparent from FIG. 1, and the arm 11, of course, is mounted by the pivot pin 11 *a* to the mounting element 4. The screws 13, 13*a* are accessible through circular apertures (unnumbered) of the mounting element 4, in a manner also readily apparent in FIG. 1.

Figure 3:
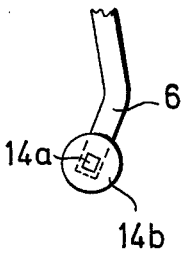

The rods or plates 6 and 7 are substantially identical in construction and include on opposite sides of one end thereof the trunnions 14, 15, respectively. Each trunnion 14 includes a projection 14*a* upon which is pinned a bushing or bearing 14*b*, while each trunnion 15 includes a projection 15*a* and a bushing or bearing 15*b*. The projections 14*a* and 15*a* are rectangular and are received in like shaped bores of the respective bearing or bushing 14*b*, 15*b* to prevent rotation of the bushings or bearings 14*b*, 15*b* relative to the respective plate 6, 7. The diameter of the bearings or bushings 14*b*, 15*b* is between two to three times the thickness of the plates 6, 7, as is most readily apparent in FIG. 3 of the drawing. The trunnions 14, 15 are received in bores, eyes or bushings 16, 17, respectively, of the mounting element 8. Although the projections 14*a*, 15*a* and bearings or bushings 14*b*, 15*b* are separate elements the same may be formed as integral elements of the rods 6, 7. The bushings or bearings 14*b*, 15*b* are preferably constructed of plastic material and preferably of an anti-friction or self-lubricating plastic. Likewise, the mounting elements 4 and 5 are also preferably constructed of plastic material although metallic material such as brass or other metal with excellent anti-friction properties may be conveniently employed depending upon the characteristics of the particular insulation involved.

Figure 5:
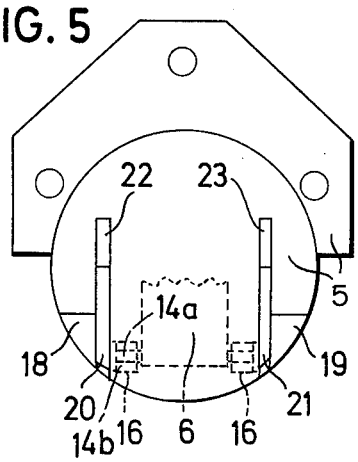
FIG. 5 is an elevational view taken generally along line 5—5 of FIG. 1, and illustrates the rear of the sash mounting of the hinge.
Figure 4:
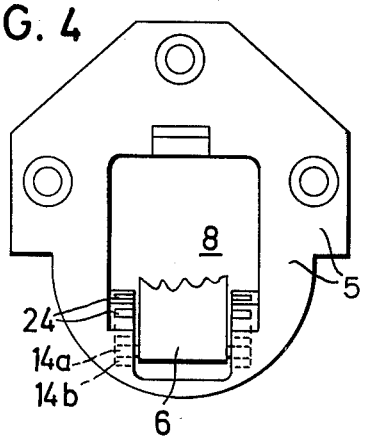
FIG. 4 is an elevational view taken generally along line 4—4 of FIG. 1, and illustrates the front of sash mounting of the hinge.

The bores 16 and 17 which receive the bearings of the trunnions 14 and 15 are preferably constructed as bores which terminate in recesses 18 and 19 of the mounting element 3, FIG. 5. Retaining plates 20 and 21 are fixedly supported in slits 22 and 23, respectively, to cover the bores 16 and 17 so that the ingress of dirt is precluded.

Since the projections 14*a* and 15*a* are integral with the rods 6 and 7, it is possible for recesses 24 to be disposed in sides in part defining the recess 8 of the element 5 to facilitate the insertion of rods 6, 7 thereinto. The bushings or bearings 14*b*, 15*b* are then inserted from the inside into the bores and are clampingly pushed on to the projections 14*a*, 15*a* after which the bores 16, 17 are closed from the exterior by means of the retaining plates 20 and 21.

While preferred forms and arrangements of parts have been shown in illustrating the invention, it is to be clearly understood that various changes in detail and arrangement of parts may be made without departing from the spirit and scope of this disclosure.

We claim:

1. A hinge comprising a pair of elements each adapted to be secured to one of a pair of relatively pivotally mounted members, a pair of radius rods having opposite side edges, first means pivotally joining said pair of radius rods at one end thereof to one of said elements, second means pivotally joining said pair of radius rods at a second end thereof to a second of said elements, said radius rods being of a predetermined thickness corresponding to the width of said side edges, at least one of said first and second pivotally joining means including laterally oppositely projecting terminal projections carrying trunnions having a diameter greater than said predetermined width of said radius rods, and means journaling said trunnions for pivotal movement in at least one of said pair of elements.

2. The hinge as defined in claim 1 wherein said projecting trunnions are defined by bushings non-rotatably carried on oppositely directed projections of said radius rods.

3. The hinge as defined in claim 1 wherein one of said pair of elements includes bores receiving said trunnions and defining a bushing therefor.

4. The hinge as defined in claim 3 wherein a retaining plate is provided for covering one of said elements, said one element having a pair of slits, and said retaining plate being insertable into said slits.

5. The hinge as defined in claim 4 wherein said trunnions are constructed of self-lubricating plastic material.

* * * * *